US010945901B2

(12) United States Patent
Scarlett

(10) Patent No.: US 10,945,901 B2
(45) Date of Patent: Mar. 16, 2021

(54) MEANS FOR CONNECTING A WHEELCHAIR BACKREST

(71) Applicant: ROLAPAL LIMITED, Auckland (NZ)

(72) Inventor: Roydon Mark Scarlett, Manukau (NZ)

(73) Assignee: ROLAPAL LIMITED, Auckland (NZ)

( * ) Notice: Subject to any disclaimer, the term of this patent is extended or adjusted under 35 U.S.C. 154(b) by 227 days.

(21) Appl. No.: 16/301,391

(22) PCT Filed: May 15, 2017

(86) PCT No.: PCT/NZ2017/050060
§ 371 (c)(1),
(2) Date: Nov. 13, 2018

(87) PCT Pub. No.: WO2017/200392
PCT Pub. Date: Nov. 23, 2017

(65) Prior Publication Data

US 2020/0330298 A1 Oct. 22, 2020

(30) Foreign Application Priority Data

May 16, 2016 (NZ) ..... 720197

(51) Int. Cl.
*A47C 7/42* (2006.01)
*A61G 5/10* (2006.01)
*A61G 5/12* (2006.01)

(52) U.S. Cl.
CPC ..... *A61G 5/1067* (2013.01); *A61G 5/122* (2016.11); *A61G 2203/78* (2013.01); *A61G 2210/10* (2013.01)

(58) Field of Classification Search
CPC .. A61G 5/1067; A61G 5/122; A61G 2203/78; A61G 2210/10
See application file for complete search history.

(56) References Cited

U.S. PATENT DOCUMENTS 5,556,168 A 9/1996 Dinsmoor, III et al.
7,066,549 B2 * 6/2006 Dennon ..... A61G 5/10 297/354.12

(Continued)

FOREIGN PATENT DOCUMENTS

| | | |
|---|---|---|
| EP | 1974707 | 1/2008 |
| NZ | 624937 | 3/2016 |
| NZ | 714174 | 6/2017 |

OTHER PUBLICATIONS

Pewrera, Asanka "International Search Report and Written Opinion" Australian Patent Office; dated Aug. 10, 2017; pp. 1-16 Nov. 20, 2018.

*Primary Examiner* — Syed A Islam
(74) *Attorney, Agent, or Firm* — Nicholas J. Landau; Bradley Arant Boult Cummings LLP

(57) ABSTRACT

The invention relates to means for releasably connecting a wheelchair backrest to a wheelchair frame. This is desirable to facilitate collapse of the wheelchair for transport or storage. In the preferred embodiment there is a wheelchair having a support frame, a backrest (16) and connector comprising a saddle (1) and a clamp (17). The saddle has a slot (3) with top and front openings and a locking lever (7). Two pins (12) are received in the slot so they extend through the front opening, and the lever (7) is able to move to divide the slot into top and bottom zones so that a lower one of the pins is prevented from being withdrawn from the slot via the top opening by the lever. The lever can then be moved to unblock the lower pin and allow the slot (3) and the pins (12) to be dissociated.

14 Claims, 4 Drawing Sheets

(56) References Cited

U.S. PATENT DOCUMENTS

| | | | | |
|---|---|---|---|---|
| 7,188,902 | B1 * | 3/2007 | Chen | A61G 5/1067 297/357 |
| 7,857,394 | B2 * | 12/2010 | Whelan | A61G 5/10 297/440.2 |
| 7,980,580 | B2 * | 7/2011 | Loewenthal | A61G 5/12 280/304.1 |
| 8,567,863 | B2 * | 10/2013 | Hetzel | A61G 5/12 297/284.4 |
| 8,657,322 | B2 * | 2/2014 | Samila | A61G 5/12 280/304.1 |
| 9,010,864 | B2 * | 4/2015 | Goeckel | A61G 5/1067 297/440.2 |
| 9,789,019 | B2 * | 10/2017 | DuFresne | A61G 5/1091 |
| 2006/0076814 | A1 * | 4/2006 | Samila | A61G 5/12 297/354.12 |
| 2008/0157581 | A1 * | 7/2008 | Whelan | A61G 5/122 297/440.2 |
| 2017/0087037 | A1 * | 3/2017 | Scarlett | A61G 5/121 |
| 2018/0014651 | A1 * | 1/2018 | Patel | A61G 5/122 |

* cited by examiner

MEANS FOR CONNECTING A WHEELCHAIR BACKREST

CROSS-REFERENCE TO RELATED APPLICATIONS

This application is a national stage under 35 U.S.C. 371 of International Application No. PCT/NZ2017/050060 having an international filing date of May 15, 2017 (currently published). International Application No. PCT/NZ2017/050060 cites the priority of NZ 720197, filed May 16, 2016 (granted Feb. 27, 2018).

FIELD OF INVENTION

A preferred form of the invention relates to means for connecting a wheelchair backrest to a wheelchair frame.

BACKGROUND

It is known for wheelchairs to be collapsible or to fold-up into a compact form for storage or transport. This is generally easier when the wheelchair has a flexible backrest, made for example out of a suitable synthetic fabric. However some people prefer a solid backrest, and in that case it may need to be removed before the wheelchair can be collapsed. It is an object of a preferred embodiment of the invention to go at least some way towards addressing this. While this object applies to the preferred embodiment, it should not be seen as a limitation on the scope of any claims not addressing it. The object of the invention per se is simply to provide the public with a useful choice.

The term "comprising" as used in this document in relation to a combination of features should not be taken to rule out the option of there being other features. The term should not be interpreted in a limiting way.

SUMMARY OF INVENTION

According to one aspect of the invention there is provided a wheelchair having:

- a support frame;
- a backrest; and
- a connector having:
  - a slot with top and front openings; and
  - a locking lever;
- the connector providing or facilitating a releasable connection between the support frame and backrest, wherein at least a pair of pins are received in the slot so they extend through the front opening and the lever is able to move to divide the slot into top and bottom portions so that a lower one of the pins is prevented from being withdrawn from the slot via the top opening by the lever, and wherein the lever can be moved to unblock the lower pin and allow the slot and the pins to be dissociated.

Optionally the backrest is rigid.

Optionally the position of at least an upper one of the pins is position adjustable to enable the amount of backrest incline to be changed.

Optionally the connector comprises a saddle.

Optionally the connector comprises a saddle, a clamp and a bracket, the clamp joining the saddle to the wheelchair's support frame and the bracket joining the saddle to the backrest.

Optionally the lever is pivotable inwards and outwards with respect to the slot.

Optionally the saddle has an opening in a sidewall thereof and a portion of the lever is able to pivot into and out of the slot via the opening.

Optionally the pins have mushroom heads that prevent them from being pulled out of the slot through its front opening.

Optionally the bracket is generally L-shaped and incorporates the pins.

Optionally bracket has elongate slots and the pins are position adjustable by way of the slots.

Optionally the lever has a pair of notches at positions corresponding to locked and unlocked positions, and the saddle is formed so that at each position a spring loaded ball bearing locates in a respective one of the notches to restrain the lever.

Optionally a leading portion of the lever butts against a ledge of the saddle when in the locked position.

DRAWINGS

Some preferred embodiments of the invention will now be described by way of example and with reference to the accompanying drawings, of which:

DETAILED DESCRIPTION

Figure 1:
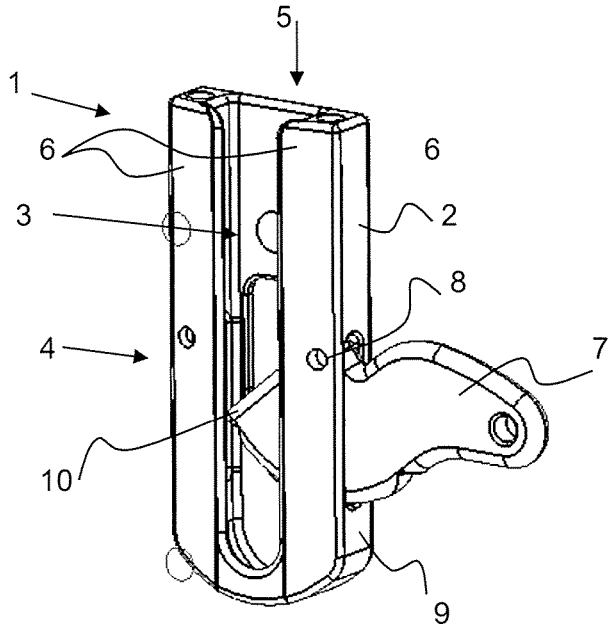
FIG. 1 is an isometric view of a saddle for use with a wheelchair backrest.

Referring to FIG. 1, the saddle 1 comprises an elongate body 2 having a slot 3 that is open at its front 4 and top 5. The front opening of the slot is narrower than its inner space on account of a pair of flange-like front walls 6. The saddle has a lever 7 that pivots from a point 8 at a medial part of the body. More specifically, the lever 7 is able to swing inwards and outwards via an opening in a sidewall 9 of the body. When swung inwards as far as it can go, the lever's leading edge 10 locks in place against the opposite side of the body. When in that position the lever effectively divides the slot into upper and lower zones. The lever can be subsequently swung back, outwards, so the slot is one zone, no longer divided.

Figure 2:
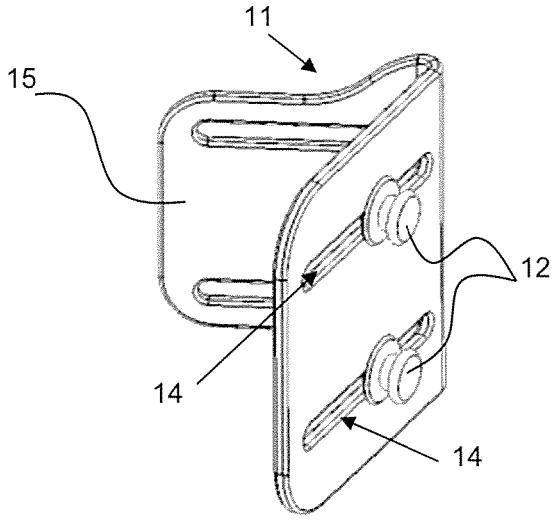
FIG. 2 is an isometric view of an L-bracket for use with the saddle.
Figure 3:
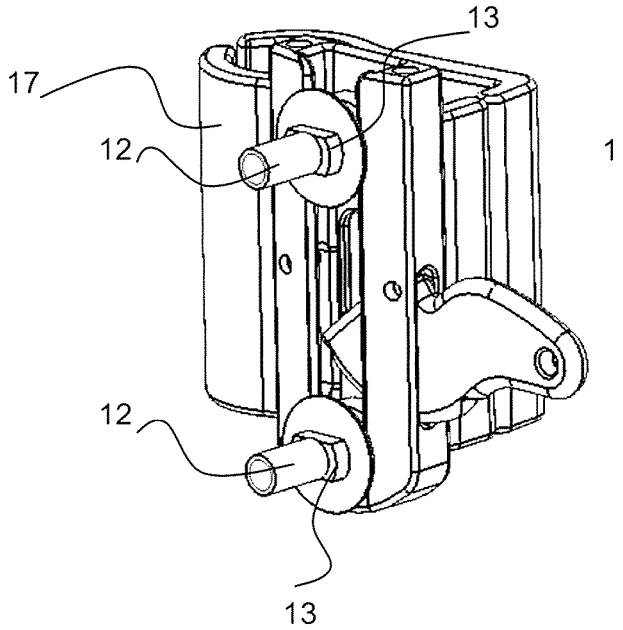
FIG. 3 is an isometric view of the saddle when combined with a clamp.
Figure 4:
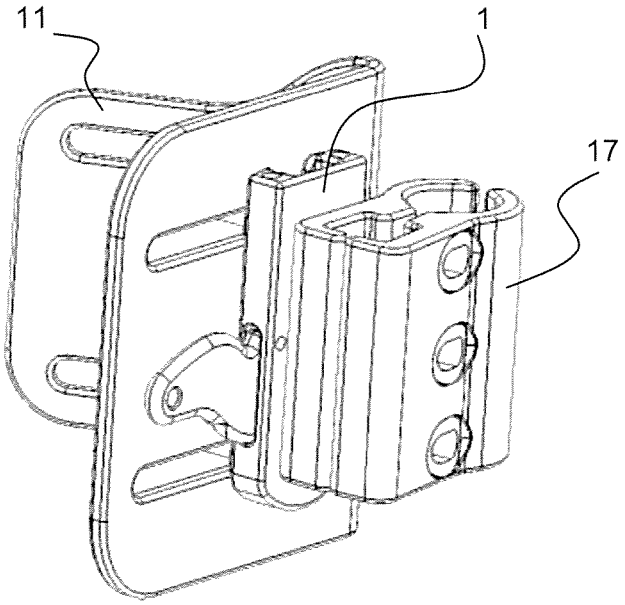
FIG. 4 is an isometric view of the saddle when combined with the clamp and the L-bracket.
Figure 5:
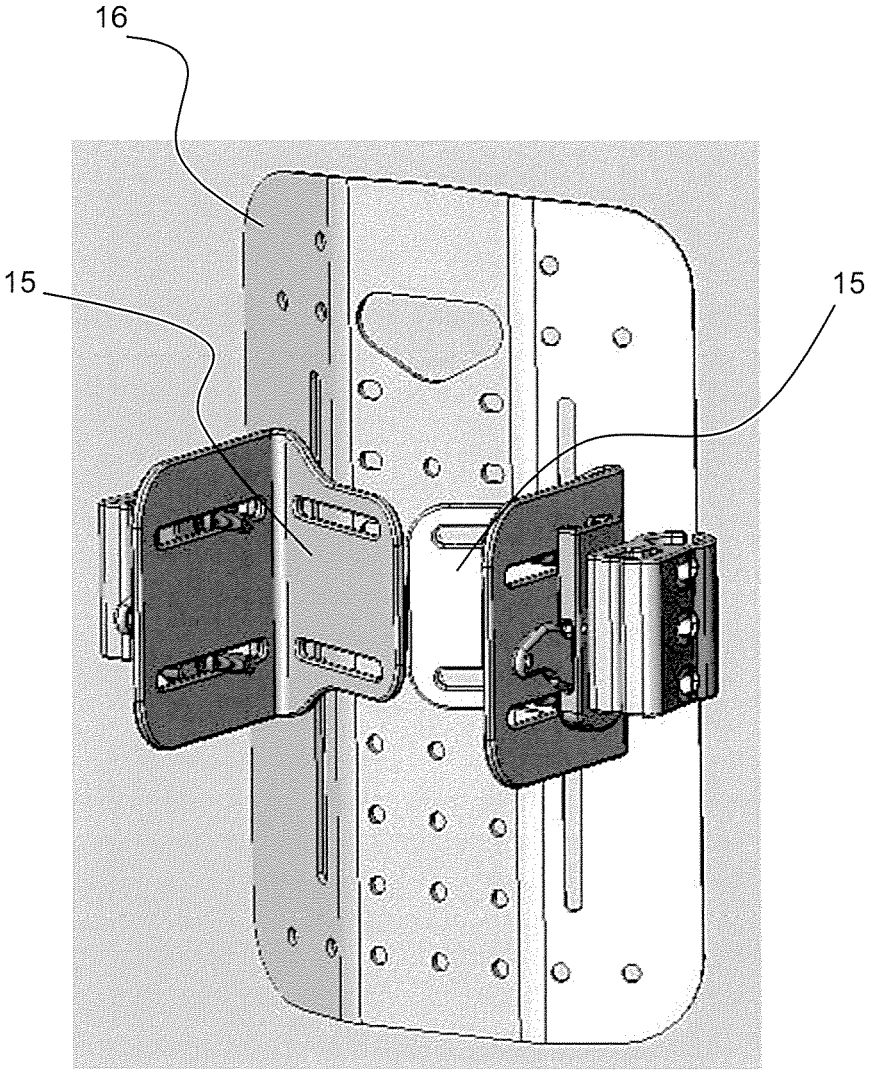
FIG. 5 is an isometric view of a rigid backrest when fitted with the saddle, the L-bracket and the clamp.

Referring to FIG. 2, the L-bracket 11 has a pair of pins 12 each having a mushroom head. The pins are fixed against the other side of the bracket with nuts. The nuts 13 are shown in FIG. 3, with the rest of the L-bracket omitted for ease of description. As shown in FIG. 2 the pins 12 are fastened through slots 14 of the plate and, by loosening and tightening the nuts 13, the position of the pins 12 can be varied. FIG. 5 shows that the arm 15 of the L-bracket that does not receive the pins is fastened against a rigid wheelchair backrest 16.

Figure 6:
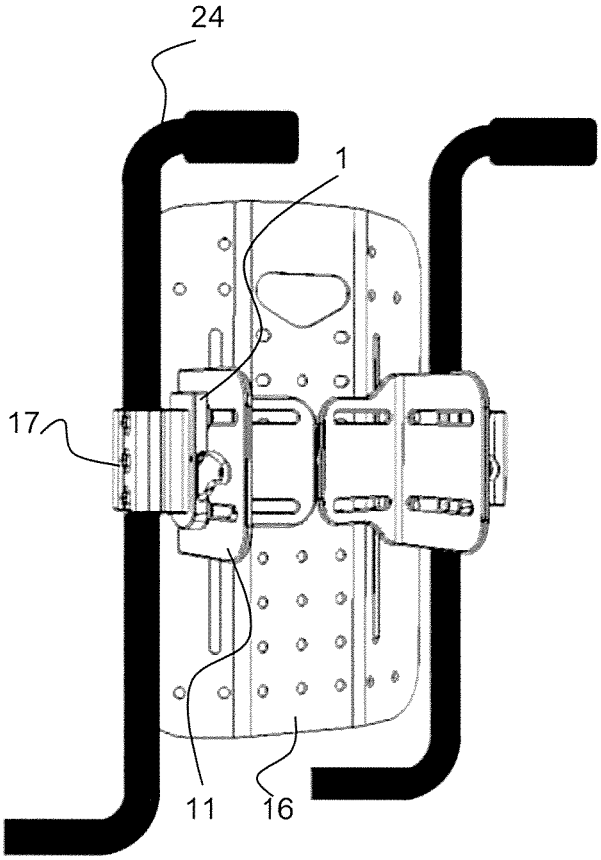
FIG. 6 is an isometric view illustrating the above items when in use as part of a wheelchair.

Turning to FIGS. 3, 4, 5 and 6, the saddle 1 is fastened to a clamp 17; the arrangement being such that the saddle 1 is sandwiched between the L-bracket 11 and the clamp. As illustrated in FIG. 6, the clamp 17 can be secured to a pole 24 forming part of a wheelchair frame.

In the preferred embodiment the saddle/L-bracket/clamp 1, 11, 17 combination is used to secure the backrest 16 to wheelchair frame poles 24 at two points, one either side of the wheelchair. While this is the preferred arrangement in some cases the attachment may be a four point one with two connection points at each pole.

Referring further to FIG. 3, the L-bracket's pins 12 are fed down into the saddle's slot 3 via its top opening. The mushroom heads of the pins 12 are unable to pull free through the front opening because of contact with the saddle's flange-like front walls 6. When the mushroom head of the lower pin sits against the bottom of the saddle 1 the lever 7 is swung inwards to lock against the opposite side of the saddle. In this position the lever 7 prevents movement of the lower pin upwards out of the slot 3. This effectively locks the saddle 1 and the clamp 17 on the one hand, to the L-bracket and backrest 16 on the other. To facilitate collapse of the wheelchair the lever 7 can be pivoted back to enable the saddle 1 and clamp 17 to be disconnected from the L-bracket 11 and backrest 16. This is because when the lever 7 is clear of the saddle's slot 3 the saddle can be slid upwards, free of the L-bracket pins 12.

The arrangement facilitates angle adjustment of the backrest. This is because the position of the upper pin 12 along the L-bracket's lateral slot 14 can be changed to suit the degree of incline of the wheelchair frame; that is without the lower pin 12 having to be adjusted. In a sense the saddle 1 and clamp 17 can collectively pivot into place about the lower pin 12.

Figure 7:
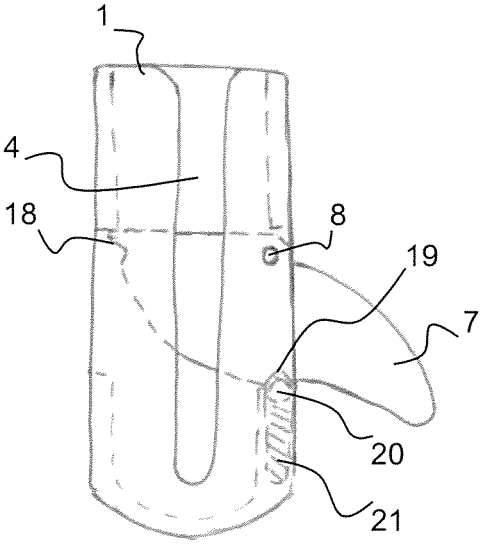
FIG. 7 is a schematic cross section front view of the saddle when its lever is in a locked position.
Figure 8:
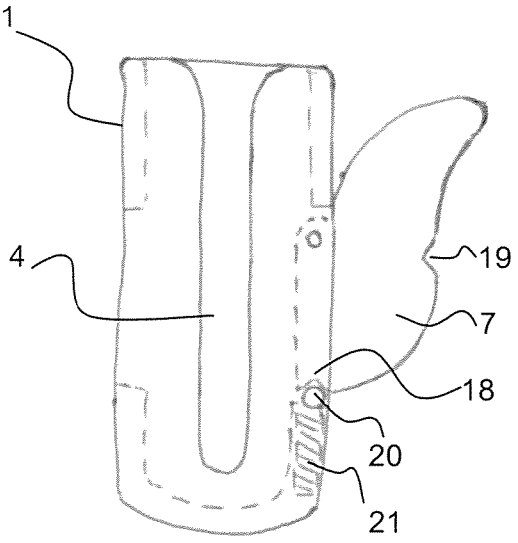
FIG. 8 shows the same front view as FIG. 7, but with the lever in an unlocked position.

FIGS. 7 and 8 show detail of the way the lever 7 engages the opposite side of the saddle. A lower edge of the lever has a pair of spaced notches 18, 19. These are arranged to receive, in turn, a ball bearing 20 set into the body of the saddle. The ball bearing is biased to move upwards by a spring 21 so that in its natural position it slots into one or other of the notches to positively keep the lever in the locked or unlocked position, as the case may be. The force of the spring can be overcome by positive hand pressure on the lever to enable it to pivot between the locked and unlocked positions. During the pivoting motion the lever's lower edge 22 runs over the ball bearing 20. This is possible without undue friction because of the resilience of the spring 21. When the lever 7 is in its locking position it butts against a ledge 23 at the opposite side of the saddle.

While some preferred embodiments of the invention have been described by way of example it should be appreciated that modifications and improvements can occur without departing from the scope of the following claims.

What is claimed:

1. A wheelchair having: a support frame; a backrest; and a connector having: a slot comprising a top opening and a front opening; and a locking lever; the connector providing or facilitating a releasable connection between the support frame and backrest, wherein at least a pair of pins are received in the slot so they extend through the front opening and the lever is able to move to divide the slot into top and bottom portions so that a lower one of the pins is prevented from being withdrawn from the slot via the top opening by the lever, and wherein the lever can be moved to unblock the lower pin and allow the slot and the pins to be dissociated.

2. A wheelchair according to claim 1, wherein the backrest is rigid.

3. A wheelchair according to claim 1, Wherein the position of at least an upper one of the pins is position adjustable to enable backrest incline to be changed.

4. A wheelchair according to claim 1, wherein the connector comprises a saddle.

5. A wheelchair according to claim 1, wherein the connector comprises a saddle, a clamp and a bracket, the clamp joining the saddle to the wheelchair's support frame and the bracket joining the saddle to the backrest.

6. A wheelchair according to claim 1, wherein the lever is pivotable inwards and outwards with respect to the slot.

7. A wheelchair according to claim 1, wherein a saddle has an opening in a sidewall thereof and a portion of the lever is able to pivot into and out of the slot via the opening.

8. A wheelchair according to claim 1, wherein the pins have mushroom heads that prevent them from being pulled out of the slot through its front opening.

9. A wheelchair according to claim 1, wherein a bracket is generally L-shaped and incorporates the pins.

10. A wheelchair according to claim 9, wherein the bracket has elongate slots and the pins are position adjustable by way of the slots.

11. A wheelchair according to claim 1, wherein the lever has a pair of notches at positions corresponding to locked and unlocked positions, and a saddle is formed so that at each position a spring loaded ball bearing locates in a respective one of the notches to restrain the lever.

12. A wheelchair according to claim 1, wherein a leading portion of the lever butts against a ledge of a saddle when in the/a locked position.

13. A connector formed for use in a wheelchair according to claim 1, the top opening of the slot having a length greater than the width of the front opening, a pivoting lever which is able to swing inwards to a locking position to divide the slot and then outwards to reverse the division, in each case via an opening in a sidewall of the connector, the connector having a ledge against which a leading portion of the lever butts when in the locking position.

14. A connector according to claim 13, wherein the lever has a pair of spaced notches and a spring biased ball bearing arranged such that when the lever is moved to locking and unlocking positions the ball bearing locates in one or other of the notches to retain the lever.

* * * * *